US008336440B2

(12) United States Patent
Mills et al.

(10) Patent No.: US 8,336,440 B2
(45) Date of Patent: Dec. 25, 2012

(54) V-HULL GEOMETRY FOR BLAST MITIGATION

(75) Inventors: Shane F. Mills, Owego, NY (US); Patrick J. Fitzgibbons, Newark Valley, NY (US); Benjamin A. Sternberg, Binghamton, NY (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1299 days.

(21) Appl. No.: 11/856,038

(22) Filed: Sep. 15, 2007

(65) Prior Publication Data

US 2012/0174746 A1 Jul. 12, 2012

Related U.S. Application Data

(60) Provisional application No. 60/844,655, filed on Sep. 15, 2006.

(51) Int. Cl.
*F41H 5/06* (2006.01)

(52) U.S. Cl. ..... 89/36.08; 89/904; 89/930

(58) Field of Classification Search ..... 89/36.08, 89/36.11, 36.12, 930, 931, 935, 936, 937, 89/904

See application file for complete search history.

(56) References Cited

U.S. PATENT DOCUMENTS

| | | | | |
|---|---|---|---|---|
| 1,149,127 | A * | 8/1915 | Giem | 89/40.03 |
| 2,959,449 | A | 4/1959 | Lazich | |
| 3,582,150 | A | 6/1971 | Williams | |
| 3,680,314 | A | 8/1972 | Toomey | |
| 3,809,191 | A | 5/1974 | Woodward | |
| 4,310,078 | A | 1/1982 | Shore | |
| 4,344,139 | A | 8/1982 | Miller et al. | |
| 4,361,871 | A | 11/1982 | Miller et al. | |
| 4,422,695 | A | 12/1983 | Farr | |
| 4,521,856 | A | 6/1985 | Phelps et al. | |
| 4,667,760 | A | 5/1987 | Takimoto | |
| 4,812,777 | A | 3/1989 | Shirai | |
| 5,085,457 | A | 2/1992 | Young | |
| 5,302,008 | A | 4/1994 | Miyake et al. | |
| 5,505,481 | A | 4/1996 | VanDenberg et al. | |
| 5,542,626 | A * | 8/1996 | Beuck et al. | 244/107 |
| 5,573,312 | A | 11/1996 | Muller et al. | |
| 5,704,632 | A | 1/1998 | Lee | |
| 5,747,721 | A * | 5/1998 | Speakes et al. | 89/36.11 |

(Continued)

FOREIGN PATENT DOCUMENTS

DE 3140492 A 6/1982

(Continued)

OTHER PUBLICATIONS

U.S. Appl. No. 11/421,523, filed Jun. 1, 2006, Craig et al.

(Continued)

*Primary Examiner* — Stephen M Johnson
(74) *Attorney, Agent, or Firm* — Slater & Matsil, L.L.P.

(57) ABSTRACT

A blast energy mitigation structure may employ a V-shaped hull to decrease the pressure wave imparted to a vehicle during a blast event, and/or an energy absorbing structure to absorb a portion of the blast force, thereby minimizing the forces and accelerations experienced by passengers in the vehicle and consequently reducing their injuries and increasing their survivability during a blast event. An exemplary blast energy mitigation structure may have a V-shaped hull and an energy absorbing structure incorporated into the chassis of a vehicle such as a Tactical Wheeled Vehicle, the energy absorbing structure comprising a truss-like structure including I-beams.

23 Claims, 6 Drawing Sheets

U.S. PATENT DOCUMENTS

| | | | | |
|---|---|---|---|---|
| 5,804,935 | A | 9/1998 | Radev | |
| 5,992,576 | A | 11/1999 | Berg et al. | |
| 6,005,358 | A | 12/1999 | Radev | |
| 6,019,436 | A | 2/2000 | Siepker | |
| 6,251,037 | B1 | 6/2001 | Baumgaertner et al. | |
| 6,358,174 | B1 | 3/2002 | Folsom et al. | |
| 6,455,947 | B1 | 9/2002 | Lilley et al. | |
| 6,461,267 | B1 | 10/2002 | Paielli | |
| 6,488,344 | B2 | 12/2002 | Huls et al. | |
| 6,582,030 | B2 | 6/2003 | Harris | |
| 6,598,943 | B2 | 7/2003 | Harris | |
| 6,626,270 | B2 | 9/2003 | Drennen et al. | |
| 6,626,271 | B1 | 9/2003 | Bohm et al. | |
| 6,647,328 | B2 | 11/2003 | Walker | |
| 6,726,592 | B2 | 4/2004 | Kotani | |
| 6,796,399 | B2 | 9/2004 | Satou et al. | |
| 6,820,946 | B2 | 11/2004 | Salamat et al. | |
| 6,824,228 | B2 | 11/2004 | Harris et al. | |
| 6,899,009 | B2 * | 5/2005 | Christiansen et al. | 89/36.02 |
| 6,923,293 | B1 | 8/2005 | James | |
| 6,959,971 | B2 | 11/2005 | Tsunehara | |
| 7,008,025 | B2 | 3/2006 | McCann | |
| 7,127,337 | B2 | 10/2006 | Bennett et al. | |
| 2001/0003401 | A1 | 6/2001 | Vikman et al. | |
| 2001/0041959 | A1 | 11/2001 | Satou et al. | |
| 2002/0109403 | A1 | 8/2002 | Yamamoto et al. | |
| 2002/0116101 | A1 | 8/2002 | Hashiba et al. | |
| 2003/0010189 | A1 * | 1/2003 | Zonak | 89/36.08 |
| 2003/0064854 | A1 | 4/2003 | Kotani | |
| 2003/0158012 | A1 | 8/2003 | Kwoka | |
| 2004/0251095 | A1 | 12/2004 | Simard et al. | |
| 2005/0032598 | A1 | 2/2005 | Hanyu et al. | |
| 2005/0146208 | A1 | 7/2005 | Wattenburg et al. | |
| 2005/0204696 | A1 | 9/2005 | Hall | |
| 2005/0269875 | A1 | 12/2005 | Maki et al. | |
| 2005/0285442 | A1 | 12/2005 | Tsukasak | |
| 2006/0138741 | A1 | 6/2006 | Dare-Bryan | |
| 2006/0152078 | A1 | 7/2006 | Bald | |
| 2008/0092730 | A1 * | 4/2008 | Hall | 89/36.04 |

FOREIGN PATENT DOCUMENTS

| | | |
|---|---|---|
| FR | 1133596 | 3/1957 |
| FR | 1202376 | 1/1960 |
| GB | 580065 | 8/1946 |
| GB | 988199 | 4/1965 |
| GB | 1375339 | 11/1974 |
| GB | 2207646 A | 2/1989 |
| GB | 2236287 A | 4/1991 |

OTHER PUBLICATIONS

U.S. Appl. No. 11/458,137, filed Jul. 18, 2006, Craig et al.

"Wherever you find heavy "Stop and Go" Brake Applications you'll find Telma Retarders", www.industrialautomatic.com/html/telma1.htm, 3 pgs, Feb. 7, 2006.

Control System, winches-aust.com/WEBPAGES/telma/pages/Control%20system%202.htm, 2 pgs, Feb. 7, 2006.

"What is a Frenelsa Electrical Retarder?", www.frenelsa.com/ingles/f_producto.html, 2 pgs, Feb. 7, 2006.

"Liebherr systems work reliably on the A380's first flight", www.liebherr.com/lh/en/5021_66442.asp, 1 pg, Apr. 27, 2005.

Operating principle, winches-aust.com/WEBPAGES/telma/pages/Operating%20principle.htm, 2 pgs, Feb. 7, 2006.

Installation, winches-aust.com/WEBPAGES/telma/pages/Installation.htm, 1 pg, Feb. 7, 2006.

Lockheed Martin Delivers Lightweight Prime Mover Vehicles to the U.S. Marine Corps, Owego, NY, Press Release dated Feb. 21, 2007.

Office Action dated Jul. 23, 2007, for U.S. Appl. No. 11/458,137.

Notice of Allowance dated Jul. 24, 2007, for U.S. Appl. No. 11/421,523.

* cited by examiner

V-HULL GEOMETRY FOR BLAST MITIGATION

This application claims the benefit of U.S. Provisional Application No. 60/844,655, filed on Sep. 15, 2006, entitled "Vehicular Based Mine Blast Energy Mitigation Structure," which application is incorporated herein by reference.

The present invention relates generally to a blast energy mitigation structure, method of system integration, and method of fabrication, and more particularly to a vehicular frame construction which is particularly suited for use in vehicles that may be subjected to explosive blasts from mines and improvised explosive devices.

Tactical wheeled vehicle (TWV) based crew members are often subjected to blast events from mines and improvised explosive devices (IEDs). Three of the types of blast events commonly encountered are (1) mines that are remotely detonated underneath the body of a vehicle, (2) mines that are contact—or pressure—detonated underneath a wheel of a vehicle, and (3) IED road blasts. Such forces and accelerations are capable of causing extensive damage to a human body, and can thereby result in the death of TWV based crew members. This poses a problem as to how to increase the survivability of TWV based crew members during a mine or IED blast event.

The blast mitigation structure of the present invention may divert and/or absorb the blast energy sufficiently to attenuate the forces and accelerations exerted on the human body, thereby decreasing crew members' actual bodily injury to a survivable level.

In an exemplary embodiment of the present invention, the problem is addressed by a combination of a "V-hull" shape and an energy absorbing structure. The V-hull shape, or V-hull, allows gaseous venting, thereby decreasing the pressure wave imparted to a vehicle during a blast event and decreasing subsequent negative effects of mine or IED blasts under a vehicle. The energy absorbing structure is designed to collapse under certain blast forces, based on its physical geometry and material properties. The energy absorbing structure may also serve as a skeleton that forms the shape of the V-hull. The combination of these two features may reduce the forces and accelerations experienced by crew members, and may thereby reduce their injuries and increase their survivability during a blast event.

The present invention may be tunable to address various mine or IED threats, within the same vehicle platform. The present invention may also be configured for use with different platforms that lend themselves to space and weight ranges similar to that of a TWV. The present invention may be adapted, for instance, for use with vehicles designed to transport dignitaries or other officials, commercial armored cars and vehicles, or helicopter and ground attack aircraft.

BRIEF DESCRIPTION OF THE DRAWINGS

The accompanying drawings are incorporated in and constitute a part of the specification.

DETAILED DESCRIPTION

While the exemplary embodiments illustrated herein may show the various features of the present invention, it will be understood that the features disclosed herein may be combined variously to achieve the objectives of the present invention.

Figure 1:
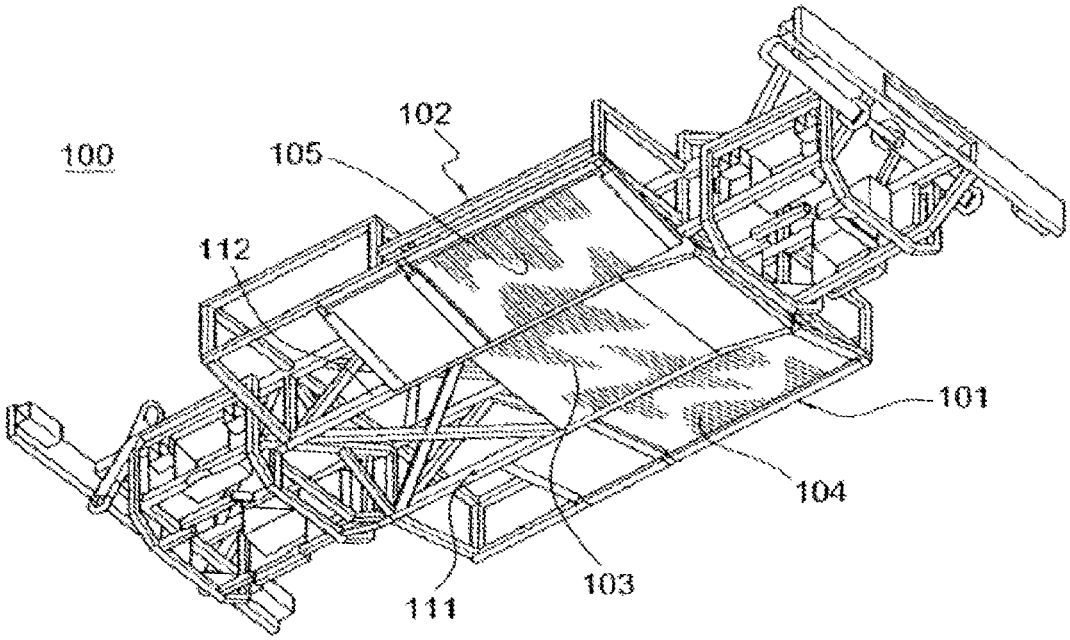
FIG. 1 shows an embodiment of the blast mitigation structure with a V-hull shape and an energy absorbing structure combined.

Turning to FIG. 1, an embodiment of the blast energy mitigation structure [100] is shown where a V-hull shape [101] and an energy absorbing structure [102] are combined. An embodiment of the V-hull shape [101] has three planes, one inner and two outer, that run longitudinally along the underside of the energy absorbing structure [102] and are joined along two longitudinal vertices formed by supporting structural members [111, 112]. The inner plane is oriented substantially parallel to the planed formed by the supporting structural members [111, 112] and runs along the longitudinal axis of the energy absorbing structure [102]. The outer planes [104, 105] are joined with the inner plane [103] along two longitudinal vertices. Each outer plane [104, 105] extends outward and upward from the inner plane [103], thereby forming a cross-section that resembles a modified "V" in form, similar, for example, to a boat hull. In the event of a blast from a mine or IED, the "V" form of the V-hull shape [101] allows for gaseous venting, thereby diverting and decreasing the pressure wave imparted to the blast energy mitigation structure [100] during the blast event.

The energy absorbing structure [102] shown in FIG. 1 is made of structural members [111, 112] that are assembled to form a truss-like structure that may collapse under certain blast forces. The energy absorbing structure [102] may also form the shape of and support the V-hull shape [101].

The V-hull may be backed up by a truss and gusset structure having cutouts and formed in a unitary cross-brace. Such a structure may absorb blast forces and add strength to a vehicle chassis. In one embodiment, a blast energy mitigation structure may comprise an energy absorbing structure attached to the underside of a vehicle chassis, adding rigidity thereto, and a hull connected to and running longitudinally along the underside of the energy absorbing structure, the energy absorbing structure comprising structural members fastened together to form a truss-like structure, and the truss-like structure comprising an upper and a lower flange portion connected by a web portion. The blast energy mitigation structure may further comprise a series of vertical structural members effective to space the truss-like structure from the vehicle chassis by a standoff distance. The truss-like structure may be a unitary structure vertically spaced from the underside of the vehicle chassis and shaped in a horizontal "X" pattern extending across the underside of the vehicle chassis.

Figure 2:
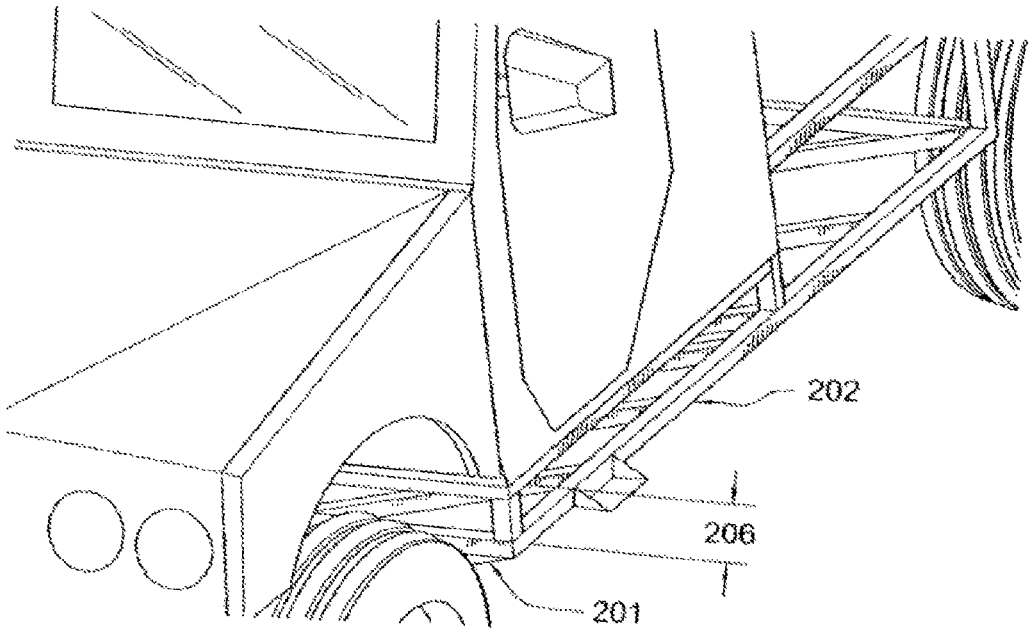
FIG. 2 shows an embodiment of the blast mitigation structure with a V-hull shape and an energy absorbing structure both incorporated into a chassis of a vehicle.

FIG. 2 shows an embodiment of the invention with the V-hull shape [201] and the energy absorbing structure [202]

incorporated into the chassis of a vehicle. In this embodiment, the longitudinal axes of the V-hull shape [201] and the energy absorbing structure [202] are substantially parallel to the longitudinal axis of the vehicle. One aspect of the energy absorbing structure [202] shown is a standoff distance [206] between the upper and lower portions of the energy absorbing structure [202]. This spatial gap is one aspect of the energy absorbing structure's [202] geometry that enables the structure to collapse under certain blast forces, thereby reducing the forces and accelerations ultimately transferred from the exterior of a vehicle to the crew members inside the vehicle.

Figure 3:
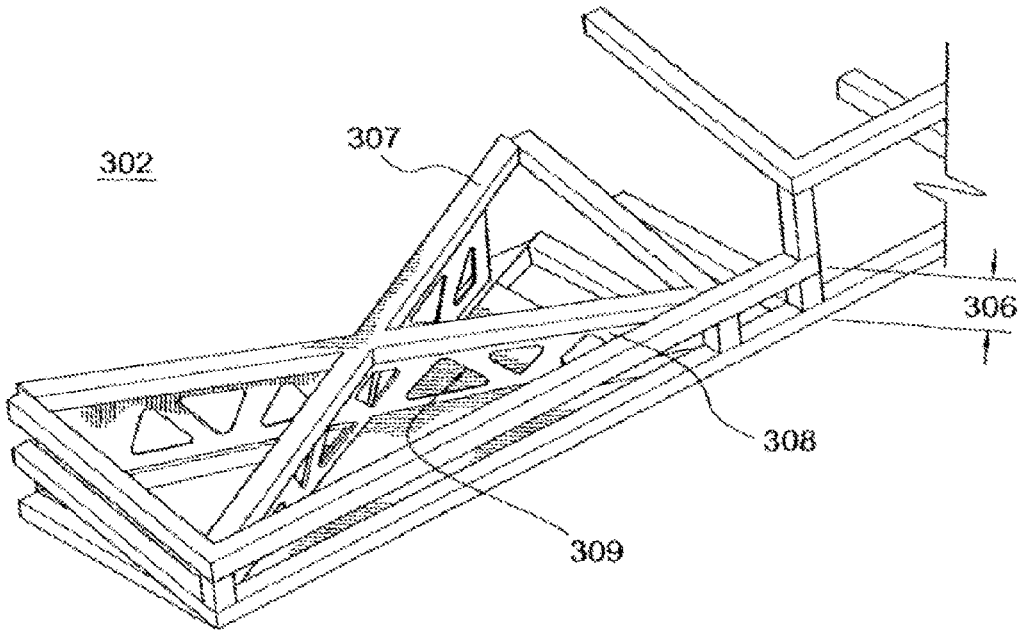
FIG. 3 shows an embodiment of an energy absorbing structure with a standoff distance and collapsible cross-bracing incorporated into the energy absorbing structure.

Turning to FIG. 3, an exemplary embodiment of the energy absorbing structure [302] is shown with a standoff distance [306] and collapsible cross-bracing [307] incorporated into the design of the energy absorbing structure [302]. In this embodiment, the collapsible cross-bracing [307] consists of structural members connected in a truss-like framework with portions of the web elements [308] removed. The resulting "cutouts" [309] in the web reduce the flexural strength of a structural member, for a given material. Specific web cutout size and placement within the webs of structural members may be designed into the energy absorbing structure's [302] geometry such that the structure will collapse under certain blast forces.

Figure 4:
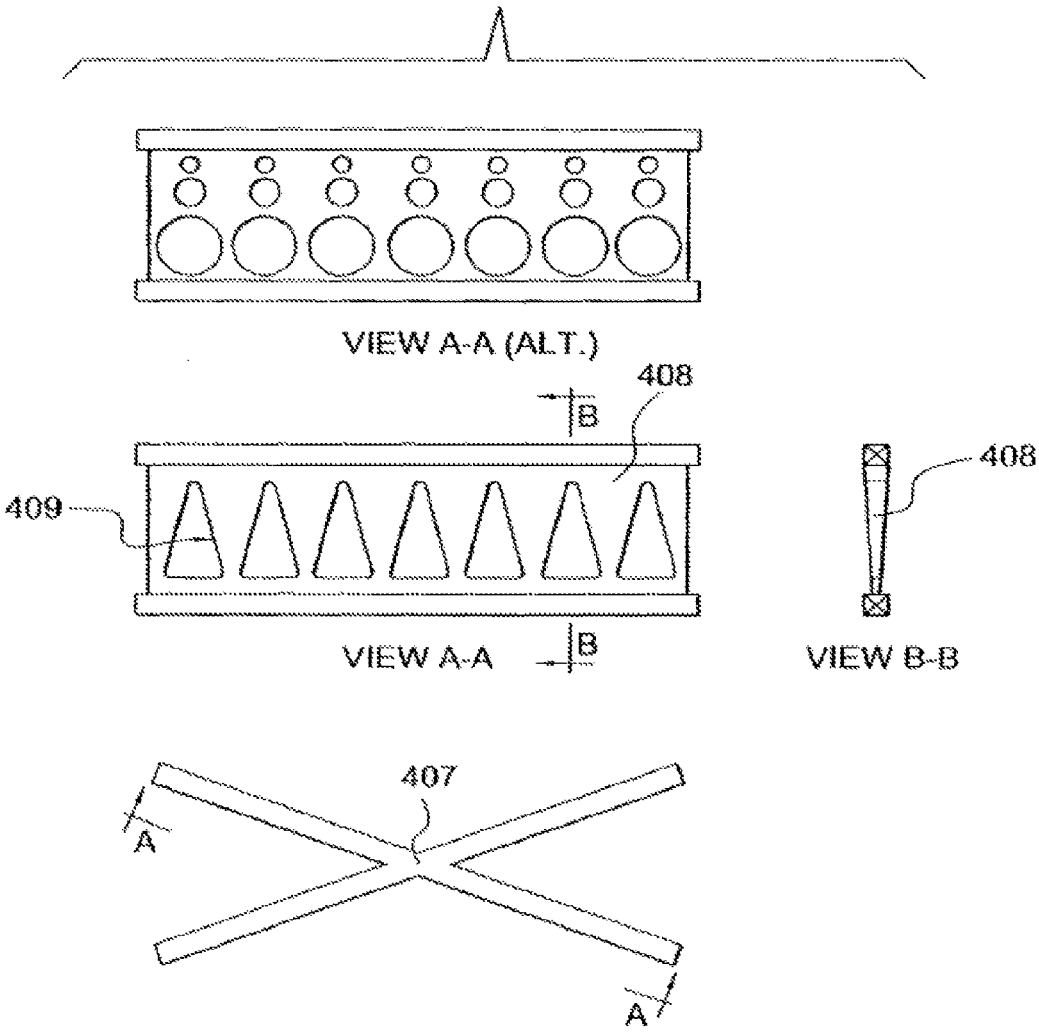
FIG. 4 shows an embodiment of the present invention where cutout sizes and placement within the webs of structural members are incorporated into the energy absorbing structure's geometry.

FIG. 4 shows an embodiment of the present invention where the cutout size and placement within the webs of structural members are incorporated into the energy absorbing structure's geometry such that the structure may collapse, based on correspondingly increasing levels of blast energy. The figure shows an "X" pattern truss-like framework [407] comprised of structural members. Views A-A and B-B show side and end views, respectively, of a structural member having cutouts [409] that decrease in size as one moves toward the upper end of the structural member. As one moves toward the upper end of the structural member, the thickness of the web [408] increases as well. These features, individually and collectively, may serve to increase the strength of the web [408] as one moves toward the upper end of the structural member, and thereby adapt the structure for collapsing successively, based on correspondingly increasing levels of blast energy. As shown in alternate View A-A, the web cutout may take various shapes and sizes.

Figure 5:
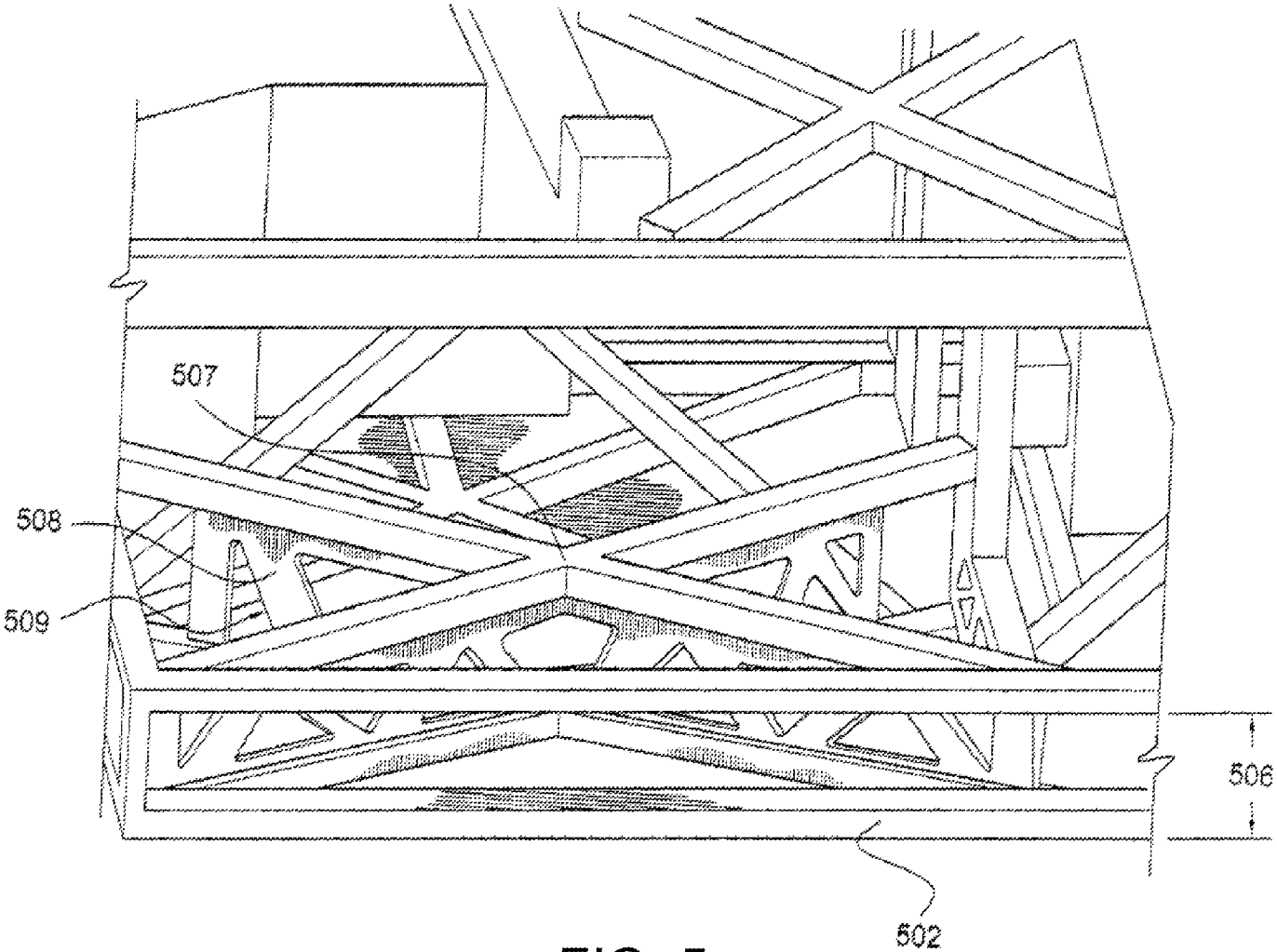
FIG. 5 shows an embodiment of an energy absorbing structure, with both a standoff distance and collapsible cross-bracing, incorporated into a chassis of a vehicle.

FIG. 5 shows an embodiment of the present invention where the energy absorbing structure [502] is incorporated into the chassis of a vehicle. The left and right ends of the figure represent the forward and aft portions, respectively, of a vehicle cab firewall and rear wall as well as the midsection of the vehicle chassis where the cab is typically integrated, although the front and rear sections of the chassis may also serve as mounting locations. This embodiment of the energy absorbing structure [502] combines web cutouts [509] within the web [508] of the cross-bracing [507] structural members, as well as a standoff distance [506] between the upper and lower portions of the energy absorbing structure [502]. These aspects of the energy absorbing structure's [502] geometry, along with structural material selection, enable the energy absorbing structure [502] to be designed to collapse under certain blast forces, thereby reducing the forces and accelerations ultimately transferred from the exterior of a vehicle to the crew members inside the vehicle. As an example, the structural geometry of this embodiment may be used to form a collapsible seat base upon which a crew member's seat may be installed in the vehicle, thereby providing a structural blast mitigation path for the seated crew member.

Figure 6:
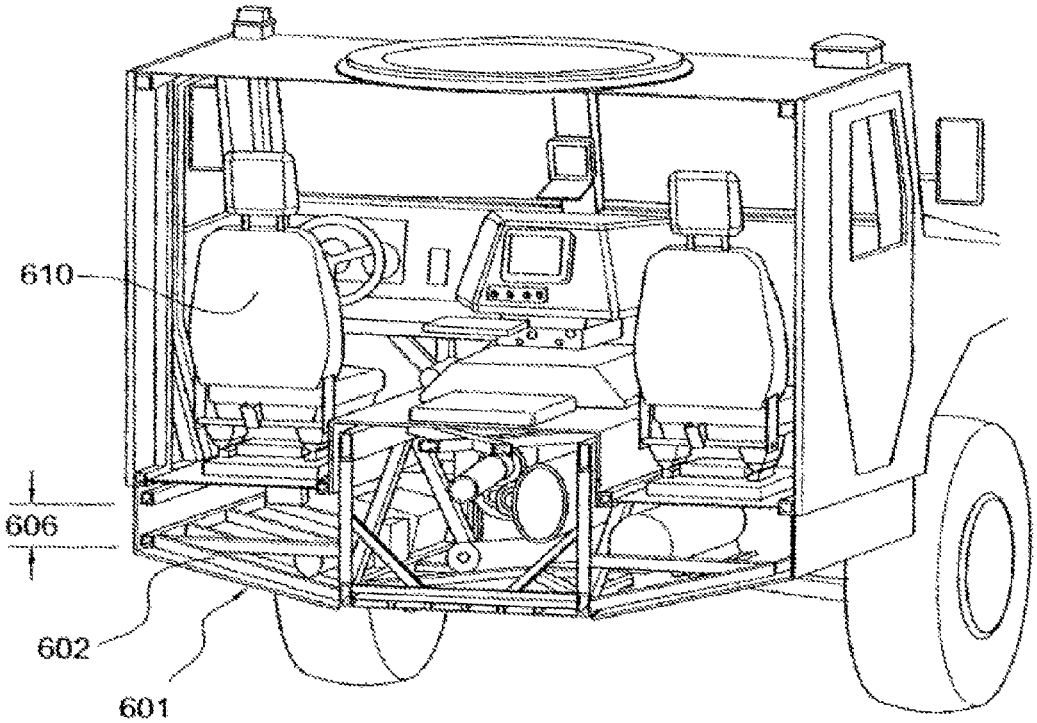
FIG. 6 shows an embodiment of the blast mitigation structure with a V-hull shape and an energy absorbing structure both incorporated into a chassis of a vehicle, and further illustrates a standoff distance and a collapsible seat base.

FIG. 6 shows an embodiment of the present invention where both the V-hull shape [601] and the energy absorbing structure [602] have been incorporated into a TWV or similar type vehicle. In this embodiment, the longitudinal axes of the V-hull shape [601] and the energy absorbing structure [602] are substantially parallel to the longitudinal axis of the vehicle. This figure illustrates how the energy absorbing structure [602] may be used to both form the shape of and support the V-hull shape [601]. It further illustrates a standoff distance [606] feature of the energy absorbing structure [602], as well as how the energy absorbing structure [602] may be used to form a collapsible seat base upon which a crew member's seat [610] may be installed in the vehicle.

In a V-hull geometry for blast mitigation, the V-hull geometry may dissipate blast force, create packaging space for componentry, and increase mobility by raking the rocker panels. The V-Hull may be backed up by a blast absorption structure such as honeycombed steel or trusses. In one embodiment, a blast energy mitigation structure adapted to surround and cover an energy absorbing structure may comprise a V-hull connected to and running longitudinally along the underside of the energy absorbing structure, comprising three planar surfaces, one inner and two outer, that run longitudinally along the underside of the energy absorbing structure and are joined along two longitudinal vertices formed by supporting structural members of the energy absorbing structure, the inner planar surface being substantially parallel to the supporting structural members, and each outer planar surface depending outward and upward from the inner planar surface, thereby forming a cross-section that resembles a modified "V" in form. The blast energy mitigation structure may be adapted for attachment to a tactical wheeled vehicle, air vehicle, or tracked vehicle, for example.

An exemplary embodiment of the present invention may include a tunable feature, whereby the blast energy mitigation structure may be designed or "tuned" to accommodate an expected level of blast energy. For instance, blast levels are often rated by the Unites States Military on a scale of one to three, with three representing the highest level of blast energy. A certain blast level may be anticipated in a given location or scenario, based on reconnaissance or other intelligence. Accordingly, the blast energy mitigation structure could be tuned, or structurally designed, to accommodate the expected blast level and subsequently incorporated into vehicles to be used in that location or scenario, thereby providing sufficient blast energy mitigation with accompanying design efficiency. Additionally, the blast energy mitigation structure may be adapted to different sections of a vehicle, such as the cargo or troop carrier sections of a TWV.

The blast mitigation structure may be adapted to bolt in and bolt out of different vehicles in the field. This may allow for selecting and installing a Blast Mitigation System that is rated for a particular blast level (i.e., level 1, 2, or 3). Such a system may be installed, removed, and replaced in the field and could be used as an alternative to, or in conjunction with, a "crumple zone" concept. In one embodiment, a line replaceable blast energy mitigation structure for attachment to a vehicle underside may comprise an energy absorbing structure and a hull connected to and running longitudinally along the underside of the energy absorbing structure, such that the line replaceable blast energy mitigation structure may be adapted for attachment to and removal from a tactical wheeled vehicle in the field in a combat area. In another embodiment, a blast mitigation system may comprise a first line replaceable blast energy mitigation structure for attachment to a vehicle underside comprising an energy absorbing structure and a hull connected to and running longitudinally along the underside of the energy absorbing structure, such that the first line replaceable blast energy mitigation structure may be adapted to absorb a first particular blast level derived from a plurality of military standard blast levels, and a second line replaceable blast energy mitigation structure for attachment to a vehicle underside comprising an energy absorbing structure and a hull connected to and running longitudinally along the underside of the energy absorbing structure, such that the second line replaceable blast energy mitigation structure may be adapted to absorb a second particular blast level, derived from a plurality of military standard blast levels, that is different than the first particular blast level.

Alternatively, an embodiment of the present invention may include variable energy absorption capability within a single blast energy mitigation structure. This may be accomplished via a series of structural zones within the blast energy mitigation structure. These structural zones could be designed with structural geometries and/or materials that vary from one zone to another such that the zones would collapse in succession, based on correspondingly increasing levels of blast energy. As an example, a vehicle equipped with a blast energy mitigation structure of this embodiment of the present invention, encountering a level-one mine or IED blast could experience collapsing of zone 1 of the blast energy mitigation structure. A similarly equipped vehicle, encountering a level-three mine or IED blast could experience collapsing of zones 1, 2, and 3 of the blast energy mitigation structure. This configuration could provide the greatest benefit to a vehicle crew from an operational scenario and mission tempo standpoint. The crew could be protected at all times to the highest level possible, without spending time on vehicle modifications.

A blast mitigation structure may be adapted to allow different zones of the structure to collapse progressively as the vehicle experiences increasing magnitudes of blast force corresponding to military standard blast forces. This may be implemented by increasing the structural web strength toward the vehicle. Decreasing the web cutout size and/or increasing the web thickness may achieve the increase in web strength. In an embodiment, a blast energy mitigation structure adapted to surround and cover an energy absorbing structure may comprise a hull connected to and running longitudinally along the underside of the energy absorbing structure, comprising two or more planar surfaces that run longitudinally along the underside of the energy absorbing structure and are joined along one or more longitudinal vertices formed by supporting structural members of the energy absorbing structure, the energy absorbing structure being comprised of structural members fastened together to form a truss-like structure, the truss-like structure forming the shape of and supporting the hull, and the energy absorbing structure further comprising a series of structural zones, each zone in the series being adapted to collapse sequentially under progressively greater structural loads. In another embodiment, each zone of the blast energy mitigation structure may be adapted to mitigate a different level of blast force. The different levels of blast force may correspond to militarily derived standard levels. In another embodiment, the blast energy mitigation structure may have three structural zones, corresponding to three militarily derived standard levels of blast force. A method of mitigating vehicular based blast energy might include specifying a specific level of expected blast energy from a blast event, designing a blast energy mitigation structure to absorb blast energy from the blast event by adapting the physical geometry of the structure to absorb the specific level of expected blast energy—by including, for instance, a series of zones that collapse sequentially under progressively greater levels of blast energy—and incorporating the blast energy mitigation structure into a vehicle for use in geographic areas subject to blast events.

Yet another embodiment of the present invention may include the use of a coating that could be applied to structural members of the blast energy mitigation structure to provide a containment surface or "skin." When subjected to a mine or IED blast, the skin could act to contain the blast force and may distribute the force to selected blast energy mitigation structural members. In an additional embodiment of the present invention, the skin could be selectively perforated in order to partially exhaust gases associated with a mine or IED blast and to effectively guide the blast force, for example, in desired directions.

Perforations added to the hull of a blast mitigation structure may result in baffling and dampening effects that may serve to "hold" the blast longer before hull rupture occurs. Additionally, a polyurea coating could be applied to the hull to increase the tensile strength of the hull substrate without adding significant weight, so that the outer hull "skin" may "hold" the blast longer. In one embodiment, a blast mitigation hull for attachment to a vehicle underside may comprise a perforated substrate extending across the vehicle underside and a coating applied to the substrate in an amount effective to increase the tensile strength of the hull in an explosive blast. In another embodiment, a blast mitigation hull for attachment to a vehicle underside may comprise a perforated substrate extending across the vehicle underside, the substrate comprising perforations selectively located and adapted to direct a blast in a desired direction. In yet another embodiment, a blast mitigation hull for attachment to a vehicle underside may comprise a substrate extending across the vehicle underside, the substrate comprising a polyurea coating applied in an amount effective to increase the tensile strength of the hull in an explosive blast.

Figure 7:
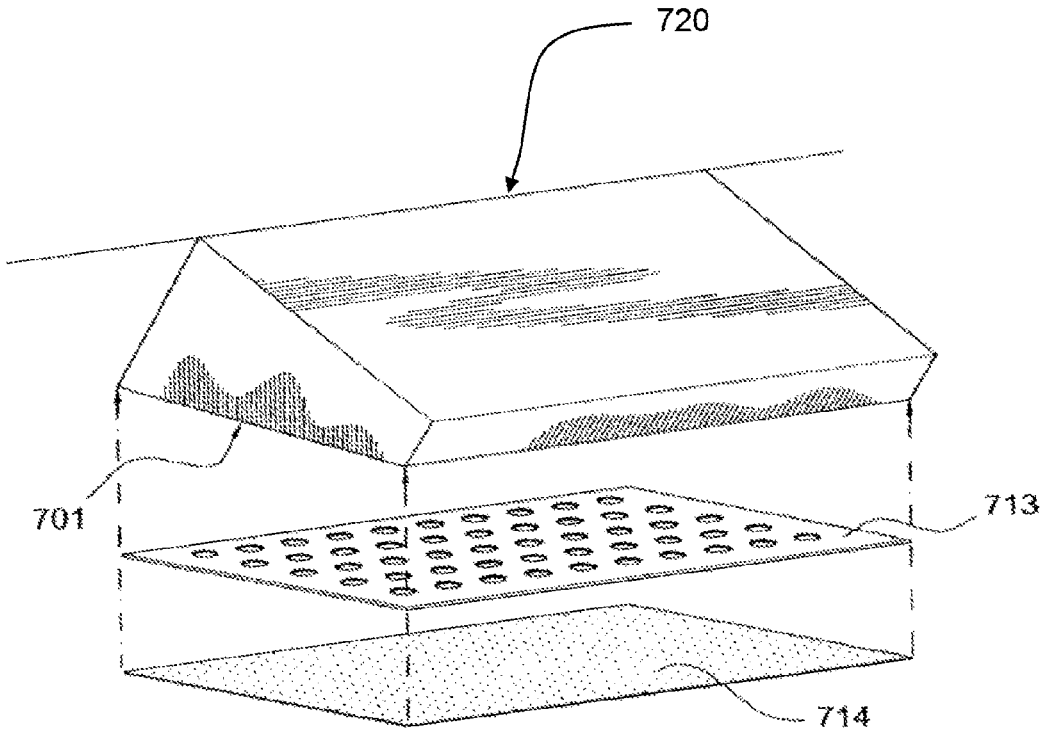
FIG. 7 shows an embodiment of the present invention with both a perforated substrate and a polyurea coating incorporated into a V-hull of a blast mitigation structure.

FIG. 7 shows an embodiment of the present invention with both a perforated substrate [713] and a polyurea coating [714] incorporated into a V-hull [701] and including rocker panels [720] in a raked orientation rising away from a center of an underside of a vehicle such as a truck of a blast mitigation structure. The rocker panels [720] are analogous to the outer panels [104, 105] illustrated and described with respect to FIG. 1.

In another embodiment of the present invention, equipment may be housed in the areas or cavities created by various blast mitigation structures. Such equipment could be designed to take on characteristics similar to those of the aforementioned structures. As an example, air tanks, for use with a Central Tire Inflation System (CTIS) and/or a vehicle suspension system, could be installed in cavities within a blast mitigation structure. When subjected to blast forces, a pressure vessel, such as an air tank, may collapse and release its pressurized contents in a predictable manner, so as to not behave like a projectile.

Compressed air tanks could be placed within the hull brace of a blast mitigation structure to absorb blast energy. Such devices may be deformed and possibly destroyed as a result of absorbing energy. These devices may also have dual use as on-board sources of compressed air. In one embodiment, a blast energy mitigation structure may comprise an energy absorbing structure attached to the underside of a vehicle chassis and adding rigidity thereto, a hull connected to and running along the underside of the energy absorbing structure, the hull defining a three-dimensional space under the vehicle chassis, and a compressed air tank placed within the three-dimensional space under the vehicle chassis. In another embodiment, the compressed air tank may serve as a source of compressed air for a central tire inflation system on the vehicle. In another embodiment, the compressed air tank could be elongated in a direction parallel to an underside of the vehicle chassis. In yet another embodiment, a blast energy mitigation device may comprise a cylindrical, air-tight vessel, having along its length a center portion and two end portions, one on either side of the center portion, two or more straps, circumferentially attached to the vessel near each of the end portions, and one or more valves attached to the vessel. A method of mitigating vehicular based blast energy may comprise specifying an expected level of blast energy from a blast event, designing a blast energy mitigation structure to absorb blast energy from the blast event by adapting the physical geometry of the structure to absorb the specific level of expected blast energy, and incorporating the blast energy mitigation structure into a vehicle for use in geographic areas subject to blast events, to include a cylindrical, airtight vessel installed horizontally within the blast energy mitigation structure, thereby providing an energy absorption device.

Any of the above features could be combined into an embodiment of a vehicular based mine blast energy mitigation structure.

It is, therefore, apparent that there is provided in accordance with the present invention, a structure for mitigating the blast energy resulting from a mine or IED blast. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A blast energy mitigation structure adapted to surround and cover a blast energy absorbing structure under a vehicle, the blast energy mitigation structure comprising:

a V-hull comprising a perforated substrate connected to and extending longitudinally along the underside of the blast energy absorbing structure, the V-hull comprising three portions, one inner and two outer, that extend longitudinally along the underside of the blast energy absorbing structure, the inner portion being substantially parallel to the underside of the blast energy absorbing structure, and each outer portion depending outward and upward from the inner portion, thereby forming a cross-section that resembles a modified "V" in form;

wherein the blast energy absorbing structure comprises structural members fastened together to form a truss-like structure, the truss-like structure forming the shape of and supporting the V-hull; and wherein the V-hull is adapted to divert and decrease a pressure wave from an explosive device detonating under the vehicle.

2. The blast energy mitigation structure of claim 1, wherein the inner and outer hull portions are planar surfaces.

3. The blast energy mitigation structure of claim 1, wherein the outer hull portions are curved surfaces.

4. The blast energy mitigation structure of claim 1, wherein the inner and outer hull portions are curved surfaces.

5. The blast energy mitigation structure of claim 1, wherein the outer hull portions are connected to the inner hull portion along longitudinal vertices.

6. The blast energy mitigation structure of claim 5, wherein the longitudinal vertices are angular.

7. The blast energy mitigation structure of claim 5, wherein the longitudinal vertices are curved.

8. The blast energy mitigation structure of claim 1, further comprising a polyurea covering on at least a portion of the V-hull.

9. The blast energy mitigation structure of claim 1, wherein the blast energy mitigation structure is adapted for attachment to a wheeled vehicle, air vehicle, or tracked vehicle.

10. A blast energy mitigation structure adapted to surround and cover a blast energy absorbing structure under a vehicle, the blast energy mitigation structure comprising:

a hull comprising a perforated substrate connected to and extending across the underside of the blast energy absorbing structure, the hull comprising three portions, one inner and two outer, that extend across the underside of the blast energy absorbing structure with each outer portion depending outward and upward from the inner portion, thereby forming a cross-section shaped like that of a boat hull;

means for supporting and forming the shape of the hull with structural members fastened together to form a truss-like structure; and means for diverting a pressure wave from an explosive device detonating under the vehicle.

11. The blast energy mitigation structure of claim 10, wherein the inner and outer hull portions are planar surfaces.

12. The blast energy mitigation structure of claim 10, wherein at least one of the inner hull portion and the outer hull portions are curved surfaces.

13. The blast energy mitigation structure of claim 10, wherein the inner and outer hull portions are coated with a polyurea coating.

14. The blast energy mitigation structure of claim 10, wherein the outer hull portions are connected to the inner hull portion along longitudinal vertices.

15. The blast energy mitigation structure of claim 14, wherein the longitudinal vertices are angular.

16. The blast energy mitigation structure of claim 14, wherein the longitudinal vertices are curved.

17. The blast energy mitigation structure of claim 10, wherein the inner hull portion is substantially parallel to the ground beneath the vehicle.

18. The blast energy mitigation structure of claim 10, wherein the blast energy mitigation structure is adapted for attachment to a wheeled vehicle, air vehicle, or tracked vehicle.

19. A method of protecting occupants of a vehicle from explosions occurring under the vehicle, the method comprising:

providing an energy absorbing structure comprising structural members fastened together to form a truss-like structure and adapted for attachment under the vehicle;

providing a hull comprising a perforated substrate disposed along an underside of the energy absorbing structure, the hull comprising three sections, one inner and two outer, that run longitudinally along the underside of the energy absorbing structure with each outer section depending outward and upward from the inner section, thereby forming a cross-section that resembles a boat hull in form;

connecting the hull to the underside of the energy absorbing structure such that the energy absorbing structure supports and forms the shape of the hull; and adapting the hull to vent gases from an explosive device detonating under the vehicle, thereby diverting and decreasing a pressure wave from the detonating explosive device.

20. The method of claim 19, wherein the vehicle is a wheeled vehicle.

21. A blast mitigation hull for attachment to an underside of a truck for protection of an occupant against an improvised explosive device detonating from under the truck, the blast mitigation hull comprising:

a perforated substrate extending across the truck underside generally in the shape of a modified "V" shape hull and including rocker panels in a raked orientation rising away from a center of the underside of the truck; and a coating on at least portions of the perforated substrate to permit the perforated substrate to hold a blast of a predetermined magnitude emanating from an improvised explosive device detonating from under the truck.

22. The blast mitigation hull of claim 21, wherein the rocker panels are planar.

23. The hull of claim 21, wherein the coating comprises a polyurea coating.

* * * * *